United States Patent [19]

Ballu

[11] Patent Number: 4,518,122

[45] Date of Patent: May 21, 1985

[54] HAND-OPERATED HOSE FOR ATOMIZING A LIQUID FOR THE TREATMENT OF PLANTS

[75] Inventor: Patrick J. Ballu, Reims, France

[73] Assignee: Tecnoma, Epernay, France

[21] Appl. No.: 642,715

[22] Filed: Aug. 22, 1984

Related U.S. Application Data

[63] Continuation of Ser. No. 406,553, Aug. 9, 1982, abandoned.

[30] Foreign Application Priority Data

Aug. 13, 1981 [FR] France ..... 81 15674

[51] Int. Cl.[3] ..... B05B 9/08

[52] U.S. Cl. ..... 239/530; 239/394; 239/575; 239/583; 239/587

[58] Field of Search ..... 239/394, 396, 397, 478, 239/479, 526, 530, 575, 583, 587, 588; 251/263

[56] References Cited

U.S. PATENT DOCUMENTS

| | | | |
|---|---|---|---|
| 3,224,793 | 12/1965 | Benjamin | 239/587 |
| 3,419,246 | 12/1968 | Burgess | 251/263 |
| 3,779,467 | 12/1973 | Arbon | 239/587 |
| 4,247,048 | 1/1981 | Hayes | 239/478 |

FOREIGN PATENT DOCUMENTS

| | | | |
|---|---|---|---|
| 2260754 | 12/1972 | Fed. Rep. of Germany | 239/530 |

*Primary Examiner*—Andres Kashnikow
*Assistant Examiner*—James R. Moon, Jr.
*Attorney, Agent, or Firm*—Watson, Cole, Grindle & Watson

[57] ABSTRACT

The invention relates to various improvements to a hand-operated hose for atomizing a liquid, especially for the treatment of plants. A tubular filter is tightened in a tubular handle by a box-nut against a transverse wall mounted in the tubular handle. This transverse wall is integrated with a rigid tube connected to a flexible feed-pipe. After dismantling of the box-nut, the filter is easily accessible for cleaning.

15 Claims, 13 Drawing Figures

HAND-OPERATED HOSE FOR ATOMIZING A LIQUID FOR THE TREATMENT OF PLANTS

CROSS REFERENCE TO RELATED APPLICATION

This application is a continuation application of application Ser. No. 406,553, filed Aug. 9, 1982, now abandoned.

BACKGROUND OF THE INVENTION

The present invention relates to a hand-operated hose for atomizing a liquid for the treatment of plants.

Hand-operated hoses are already known for this application, each comprising, at the end of a flexible liquid feed-pipe, a rigid handle, which is provided with an inlet valve and a control trigger for this valve and which is extended by a rigid tube carrying an atomizing head at its end.

Generally, a filter has to be provided upstream of the atomizing head of the hand-operated hoses of this kind; experience has shown that this filter becomes clogged rather rapidly; however, in hand-operated hoses of this type that have been hitherto developed, cleaning of the filter is a long and cumbersome operation, since it necessitates the dismantling of several elements; this is particularly the case when the filter is placed, in a known manner, at the level of the connection between the reservoir for the liquid under pressure, on the one hand, and the corresponding end of the flexible feed-pipe of the hose, on the other hand.

The hand-operated hoses of this known type are not entirely satisfactory either from the point of view of the possibilities they offer for aligning the atomizing head with respect to the axial direction of the hose, particularly of its rigid tube. In a prior embodiment, in particular, the atomizing head is mounted swivelling about an axis forming an angle of 90 degrees with the rigid tube of the hose; thus it is possible to let the atomizing head swivel with respect to the rigid tube of the hose, as a rule by an angle of between minus ninety degrees and plus ninety degrees; however, the embodiment is such that the atomizing head cannot be brought, and then kept, in a definite angular position with respect to the rigid tube of the hose, except by two successive operations, one of loosening a screw and the other of tightening it. In practice, therefore, it is impossible, or at least cumbersome and relatively long, to let the atomizing head be passed through by a major solid angle ahead of the hose, which is supposed to be kept in a fixed direction by its user.

The present invention makes it possible to develop, for the application mentioned, an improved hand-operated hose, which does not possess the various shortcomings of the hand-operated hoses that have been hitherto developed, the list, given above, of these various shortcomings being, moreover, not exhaustive.

SUMMARY OF THE INVENTION

The hand-operated hose for atomizing a liquid for the treatment of plants according to the present invention is of the type indicated in the foregoing and can be provided with this first improvement: a prismatic or cylindrical filter, one base of which is open and the other closed by a projecting part, being passed through by the movable body of the inlet valve, is immobilized in the front portion of the tubular handle, located on the side of the atomizing nozzle, by a box-nut, screwed onto the front portion and equipped with a tube, one end of which passes through the open base of the filter and carries the seat of the inlet valve, its other end serving for the connection with the atomizing head, and that a rigid nozzle, extending the flexible feed-pipe inside the tubular handle, is integrated with the base part of the filter so as to issue in an annular chamber situated between the wall of the filter, on the one hand, and, on the other hand, the inner walls of the tubular handle and, possibly, of the box-nut.

As a result of this arrangement, the filter of the hand-operated hose according to the present invention, which is accommodated in the front portion of the tubular handle of the hose, can be easily cleaned, since it is possible to reach it easily by unscrewing the box-nut, which immobilizes it in said front portion of the tubular handle; in fact, when the box-nut has been removed, it is enough, for proceeding with the cleaning of the filter, to take it out of the open front portion of the tubular handle, particularly by pushing it out by means of the flexible feed-pipe, and out of the rigid nozzle extending it and which is integrated with the base of the filter. The reverse operations enable the cleaned filter to be replaced easily and rapidly, and the latter element is never in danger of being lost, since it cannot be separated from the rigid nozzle.

In a preferred embodiment of the hand-operated hose according to the present invention, the different parts, accommodated in the tubular handle, are dimensioned so that the cylindrical or prismatic filter normally engages with only a fraction of its length with the front portion of the handle. This arrangement makes it even easier to extract the filter from the tubular handle by the operations indicated above, but, in addition, it makes it possible to reach the filter after only removing the box-nut, since the filter then projects, along a greater or smaller fraction of its length, beyond the open end of the front portion of the tubular handle; it is possible, in fact, in this position of the filter, which is still partially engaging with the tubular handle, to undertake rapid cleaning of the filter, which may be good enough, especially when it is not badly clogged.

According to another advantageous aspect of the invention, the control trigger, which is articulated to the movable part of the body of the inlet valve which lies outside the filter, can project out of the tubular handle through a longitudinal slit, having sufficient length for enabling the trigger to engage, if desired, along its whole length inside the handle. This arrangement makes it possible to prevent the trigger, articulated to the movable body of the inlet valve, from obstructing the movement towards the outside of the assembly formed by the filter, its base, the movable body of the inlet valve, the trigger, the flexible feed-pipe and the rigid nozzle extending it, and even hinders the, at least, partial removal of this assembly from the tubular handle.

According to another advantageous improvement in accordance with the invention, the control trigger may have, in front of its articulated joint to the valve-body, an extension which interacts with a fixed incline that is designed in such a way that, when traction is manually applied to the trigger, the incline guides its extension, so that its articulated joint exerts on the valve body overdrive traction which is sufficient for overcoming the force of an automatic closing spring of the valve and causing the latter to open. Preferably, too, the incline possesses a ratchet element which ensures the temporary locking of the trigger in a position corresponding to the opening of the valve. In this preferred embodiment, the control trigger of the hand-operated hose according to the present invention enables the inlet valve to be opened not only temporarily, but also for controlled periods, as well as opened permanently, which is achieved by bringing the trigger into a definite position.

According to another improvement of the hand-operated hose in accordance with the present invention, the atomizing head is mounted swivelling about a first axis, making with the axis of the handle extension an angle $\alpha$ less than 60 degrees, preferably an angle $\alpha=30$ degrees. In a preferred embodiment, the support of the swivelling atomizing head is itself mounted swivelling about a second axis, coinciding with that of the handle extension, and the assembly is dimensioned such that the mean direction of the jet is inclined by the same angle $\alpha$ to the first swivelling axis of said head.

In the case of this last embodiment, the axis of the jet emerging from the atomizing head makes an angle $2\alpha$, for example of 60 degrees, with the axis of the handle extension, so that, by letting the atomizing head assembly swivel about its first swivelling axis—inclined at 30 degrees to the extension axis—it is possible to pass through the jet the surface of a cone of revolution having a vertex angle equal to 60 degrees; by letting, moreover, the atomizing head assembly swivel about the second axis, that is to say the extension axis, it becomes possible to pass through the jet the whole of a solid angle defined by a cone of revolution about the extension axis, having a vertex angle equal to $4\alpha=120$ degrees.

By way of example, several embodiments of the hand-operated hose according to the present invention have been described below and diagrammatically illustrated in the attached drawing.

DETAILED DESCRIPTION OF THE PREFERRED EMBODIMENTS

Figure 1:
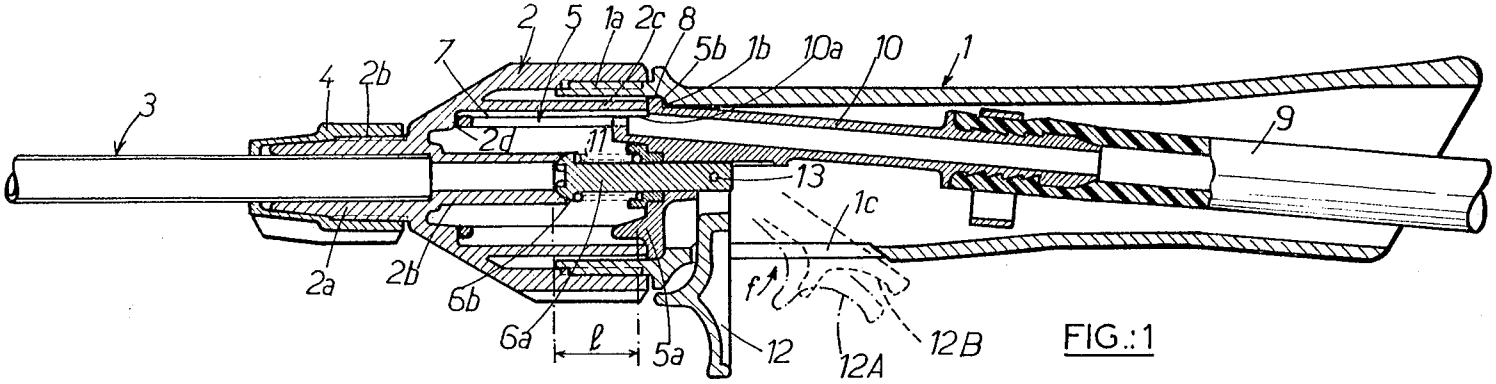
FIG. 1 is a view, in section through an axial plane, of the handle of a hand-operated hose according to the present invention.
Figure 2:
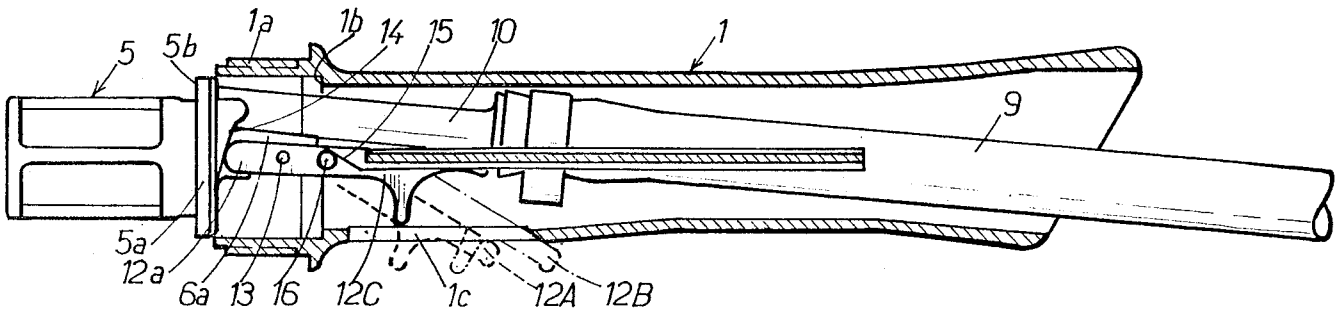
FIG. 2 is a vew, in partial section, illustrating the removal of the filter from the inventive handle, shown in FIG. 1.

In FIGS. 1 and 2, 1 denotes a tubular handle made, for example, of moulded plastic, which is open at its two ends; a thread 1*a*, onto which a box-nut 2, for example, a standard "34 gas" type nut, can be screwed, is made on the front end of the handle 1, that is to say, its end situated on the left hand side of FIG. 1, on the side nearest the atomizing head (not shown in this figure) of the hand-operated hose. This box-nut 2 is equipped, in its centre part, with a tube element 2*a*, one end of which projects in the direction of the atomizing head; engaging in this tube element 2*a* is the corresponding end of a rigid tube 3 made, for example, of aluminum, on the other end of which the atomizing head, which will be described later on, is mounted. A box-nut 4 is threaded onto the corresponding end of the rigid tube 3 and screwed onto a thread 2*x*, which is provided externally on the tube element 2*a*, so as to immobilize the associated end of the rigid tube 3 inside the tube element 2*a*. Immobilized in the chamber formed by the interior of the box-nut 2 and the front portion, which is open, of the tubular handle 1 is a filter 5 having a prismatic or cylindrical surface, one base of which, located on the side of the box-nut 2, is open, while its other base, situated inside the front portion of the tubular handle 1, is closed by a transverse part 5*a*, made of metal or plastic, which is penetrated under seal by the movable body 6*a*, having the shape of a piston of an inlet valve. The assembly of the filter wall and of the base 5*a* of the filter 5 can consist, for example, of a single part made of moulded plastic. The base 5*a* of the filter projects on both sides of its lateral filter surface in the form of a kind of annular collar 5*b*. To bring about the tightening of the filter, the box-nut 2 is provided, on the one hand, with an inner element in the form of a skirt 2*c*, which presses the annular collar 5*b* of the base 5*a* of the filter 5 against a suitable inner shoulder 1*b* of the tubular handle; the other base, which is open, of the filter 5, on the other hand, is brought to bear, when the box-nut 2 is tightened on the thread 1*a* of the tubular handle 1, against a bearing 2*d* developed inside the box-nut 2 in such a position that a narrow annular chamber 7 is left between, on the one hand, the element in the form of a skirt 2*c* of the box-nut 2 and, on the other hand, the lateral filter surface of the filter 5. A single annular tight joint 8 ensures tightness to the outside of the annular chamber 7 defined above. A flexible feed-pipe 9 for the treatment liquid, one end of which is connected to a reservoir for liquid under pressure, passes with its other end into the rear portion (see the right-hand side in FIGS. 1 and 2) of the tubular handle 1; inside the tubular handle 1 the flexible pipe end is mounted so as to ensure tightness onto a rigid nozzle 10, which, in turn, is integrated with the base 5*a* of the filter 5, particularly at the level of its projecting portion 5*b*; as is seen in FIG. 1, the inner channel of the nozzle 10 issues through an orifice 10*a* in the annular chamber 7 defined above, that is to say in the gap between the element in the form of a skirt 2*c* of the box-nut 2, on the one hand, and the lateral filter wall of the filter 5, on the other hand.

The box-nut 2 also possesses, in the extension of its outer tube element 2*a* mentioned above, an inner tube element 2*b*, the end of which passes through the open base of the filter 5 and carries the seat 6*b* of the inlet valve. This latter is normally kept closed, for example by an automatic closure spring 11 which engages around the movable body 6*a*, in the form of a piston, and which rests, at one end, on the inner face of the base 5*a* of the filter 5 and, at its other end, on a bearing developed behind the part of the movable body 6*a*, which is designed to interact with the seat 6*b*.

Besides, the tubular handle 1 is equipped with a control trigger for the inlet valve; this trigger 12 is articulated at 13 to the part of the movable body 6*a* of the inlet valve, which is on the outside of the filter 5; it can project from the tubular handle 1 through a longitudinal slot 1*c*, which has a sufficient length for enabling the trigger 12 to be engaged, if desired, along its whole length inside the tubular handle 1, as indicated by a solid line in FIG. 2, where this position, completely retracted, of the trigger is denoted by 12C.

Figure 4:
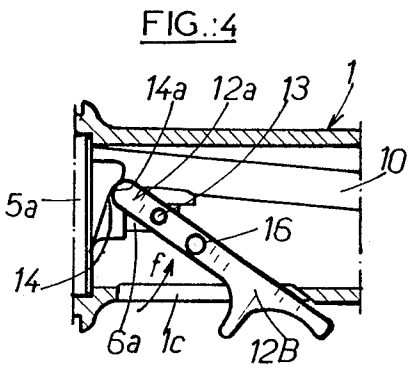
FIGS. 3 and 4 respectively show two different operative positions of the control trigger of the inventive handle shown in FIGS. 1 and 2.
Figure 3:
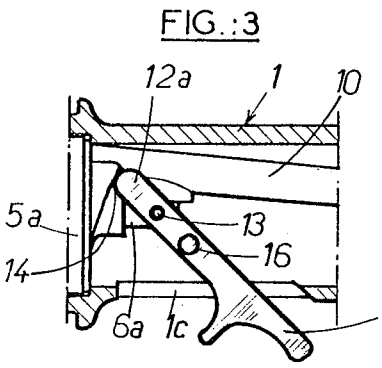

According to another aspect of the invention, the trigger 12 has, in front of its articulated joint 13 to the valve body 6*a*, an extension 12*a* (FIGS. 2 to 4), which interacts with an incline 14 that is integrated with the projecting base 5*a* of the filter 5. When one of the fingers of the hand of the operator who carries the hose by its handle 1 pulls back, that is to say towards the right-hand side of the different FIGS. 1 to 4, with the trigger 12 in its almost vertical position, corresponding to the automatic closure of the inlet valve by the spring 11, the trigger swivels about its articulated joint 13 in the direction of the arrow f (FIG. 1), for example into a first position 12A sloping to the rear (see, in particular, FIGS. 1 to 3); under the influence of traction, the trigger 12 comes to rest with its extension 12*a* against the fixed incline 14, so that its articulated joint 13 has exerted on the valve-body 6*a* an overdrive traction, which, by overcoming the force of the automatic closure spring 11, has lifted the valve-body 6*a* from its seat 6*b*. When the trigger has been brought into an extreme position 12B (see, in particular, FIGS. 1, 2 and 4) the extension 12*a* of the trigger interacts with a ratchet element 14*a* provided on the corresponding part of the incline 14 and designed so as to temporarily lock the trigger in its position 12B, corresponding to the opening of the valve 6*a*–6*b*.

The hand-operated hose according to the present invention, equipped with the handle described above, works in the following way:

When treatment liquid under pressure passes into the annular chamber 7 through the flexible feed-pipe 9 and the nozzle 10, it penetrates to the inside of the filter 5 by crossing its lateral filter wall. As long as no force is exerted on the control trigger of the inlet valve, which is then in its position 12, the treatment liquid which has entered the interior of the filter 5, cannot pass into the rigid tube 3. When, however, the operator makes the trigger 12 swivel in the direction of the arrow f (FIG. 1), for example into a position 12A, the opening of the inlet valve permits the passage of the treatment liquid into the tube 2*b* of the box-nut 2 and then into the rigid tube 3, at a flow-rate depending on the gap between the movable body 6*a* of the inlet valve and its seat 6*b*, which in turn is based on the swivelling of the trigger from its closed position 12. If the operator releases the trigger from a position such as 12A, the spring 11 closes the inlet valve, which interrupts the atomisation of treatment liquid, and, at the same time, the force resulting from the release of the spring 11 is transmitted by the articulated joint 13 to the control trigger so as to return the latter to its closed position 12. If, on the other hand, the trigger is brought from an open position such as 12A into its extreme position 12B, it is locked in this latter position by the interaction of its extension 12*a* with the ratchet element 14*a* of the incline 14 (FIG. 4), so that the trigger resists the force exerted by the automatic closure spring 11; the inlet valve therefore remains in its open position, corresponding to the position 12B of the trigger, until the operator exerts on this latter element a pressure in the reverse direction to the arrow f, the trigger then being returned to its closed position 12 by the action of the spring 11 as soon as the extension 12*a* of the trigger has ceased to interact with the ratchet element 14*a*.

For proceeding with the cleaning of the filter 5, it is sufficient to unscrew the box-nut 2 until it is possible to separate it from the tubular handle 1. In the arrangement illustrated in FIG. 1, the filter, in the operational position, engages only over a fraction, l, of its length L with the interior of the front portion of the tubular handle 1. Consequently, after the removal of the box-nut 2, the filter 5 projects beyond the front portion of the tubular handle 1 over a length (L−l), so that, if it is not too badly clogged, it can be cleaned without being taken completely out of the handle 1, for example by passing it under a running water tap or by immersing it in a container of water and agitating it there. If, on the other hand, the filter requires more extensive cleaning, it is easy to take it completely out of the tubular handle 1 by pushing the flexible feed-pipe 9 towards the left in FIGS. 1 and 2; this latter figure shows particularly the filter 5 completely taken out of the tubular handle 1; this removal of the filter has been made possible by the fact that the tubular handle 1 is equipped on the inside with at least one projection 15 (FIG. 2), especially in the form of an incline, which is placed so as to interact with at least one projection of the trigger 12, especially in the form of a lug 16, so that, when the filter 5 is pushed into the front portion of the tubular handle 1 to the front, that is to say towards the left-hand side of FIG. 2, the trigger 12 swivels so as to re-enter the tubular handle 1 completely, through the longitudinal slit 1*c*; having reached its position 12C, the trigger evidently does not resist the removal of the filter 5 from the handle 1 any longer. The filter 5, completely taken out of the handle 1, can then be thoroughly cleaned by one of the methods indicated above and/or by brushing, and can then be re-inserted inside the tubular handle 1 by exerting on the flexible feed pipe 9 a traction force towards the right-hand side of FIG. 2; during the movement of the assembly 5-5*a*-16-9-10-12 towards the right, interaction between the lug 16 of the control trigger and the incline 15 causes the trigger to swivel from its position 12C to its position 12B. It is then sufficient to screw the box-nut 2 back onto the thread 1*a* of the tubular handle 1 and then to return the trigger manually from its temporary locked position 12B to its closed position 12.

Figure 5:
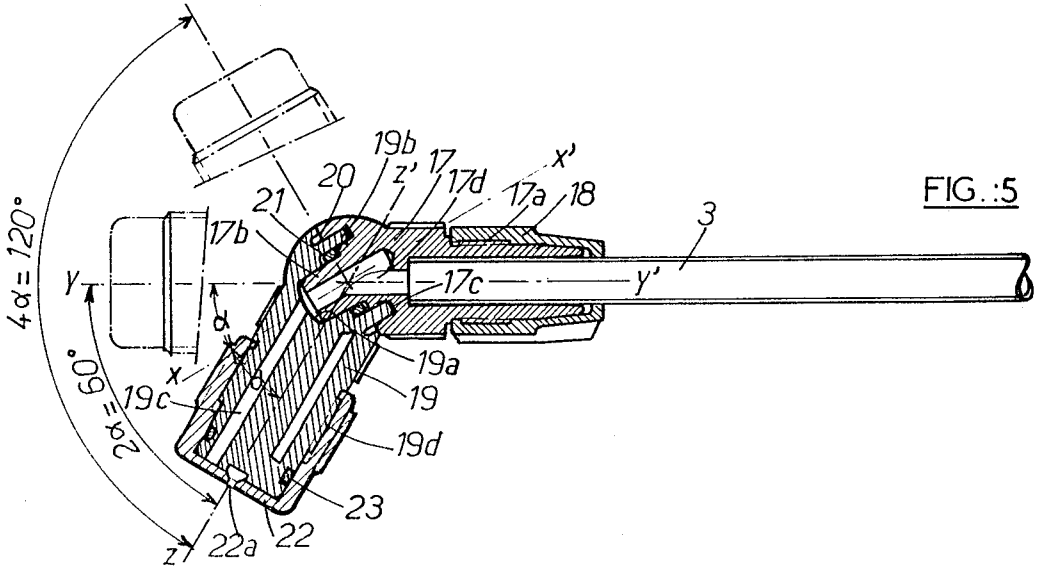
FIGS. 5, 6, 8 and 11 show four different embodiments of the atomizing head of a hand-operated hose according to the present invention, each in section through an axial plane.

FIG. 5 shows a particularly advantageous embodiment of the atomizing head of a hand-operated hose according to the present invention. This atomizing head comprises, in the first place, a tubular shoulder 17 having, in its right-hand portion (in FIG. 5), a bore in which the end of the rigid tube 3 of the hand-operated hose, which faces the handle of the latter, can be inserted. The tubular shoulder 17 constitutes a nozzle-mounting means. A box-nut 18, threaded over the end of the tube 3, can be screwed onto an external thread 17*a* of the shoulder 17, so that the tightening of the nut 18 ensures immobilization of the shoulder 17 on the end of the rigid tube 3. It should be noted that, by slightly loosening the nut 18, the shoulder 17 of the atomizing head, and therefore the assembly of this latter, can be made to swivel about an axis which coincides with the axis y—y′ of the rigid tube 3 of the hand-operated hose, in which case the range of this swivelling motion can have any value between 0 and 360 degrees. The end of the shoulder 17 facing the rigid tube 3, on the other hand, is designed so as to form a tight bearing for one end of a nozzle 19 of the atomizing head, which bearing enables the head to be manually swivelled about another axis x—x′; in the exemplary embodiment under consideration this axis x—x' makes equal angles of the same value $\alpha$, less than 60 degrees, with the axis y—y' of the rigid tube 3, on the one hand, and with the axis z—z' of the nozzle 19, on the other hand, this axis z—z' coinciding with the mean direction of the jet of atomized liquid as will be specified later on. In the exemplary embodiment illustrated, the opposite ends of the shoulder 17 and of the nozzle 19 are placed on each other by planar bearings such as 20, situated in a plane perpendicular to the axis x—x'; these two parts, 17 and 19, on the other hand, are integrated in rotation by engagement, for example by easy friction, with an end of a hollow shaft 17*b* of the shoulder 17, in a corresponding bore 19*a* of the nozzle 19, as well as by engagement with a cylindrical skirt 19*b* of the nozzle 19, in a corresponding annular groove 17*c* of the shoulder 17; known ratchet means are provided in order to avoid separation of the parts 17 and 19; a sealing O-ring 21 on the other hand, is inserted between the end of a hollow shaft 17*b* of the shoulder 17 and the skirt 19*b* of the nozzle 19. In this latter element, a duct 19*c* is developed parallel to the axis z—z' so as to issue, at one end, in the bore 19*a*, at the level of the x—x', and, at its other end, on the face of the nozzle 19, which is turned outwards. The side wall of the nozzle 19 is provided with a thread 19*d*, onto which a box-nut 22 is screwed, the base of which is penetrated by an atomisation outlet-tube 22*a*; a sealing O-ring, 23, is inserted in an annular recess of the side wall of the nozzle 19, in which recess said ring 23 is tightened by the inner wall of the box-nut 22.

When the inlet valve of the hand-operated hose according to the present invention is opened by the operator acting on the corresponding trigger, the treatment liquid under pressure is passed through the rigid tube 3 into a bent bore 17*d*, which is worked into the shoulder 17, so as to let the liquid pass into the bore 19*a* of the nozzle 19 and, from there, into its duct 19*c*. This is independent of the position of the nozzle 19 about its pivoting axis x—x', since the duct 19*c* issues in the bore 19*a* at the level of the axis x—x', that is to say at a fixed point with respect to the outlet of the bore 17*c*. If the box-nut 22 is not completely tightened, the liquid under pressure passes from the left end of the channel 19*c* into the narrow gap that lies between the base of the box-nut 22, on the one hand, and the corresponding face of the nozzle 19, on the other hand, the liquid under pressure then escaping from the atomising head through the outlet tube 22*a*. By modifying the relative position of the box-nut 22 and of the nozzle 19, that is to say by screwing on or unscrewing the box-nut 22, it is possible to vary the conical shape of the liquid jet emerging from the outlet tube 22*a*, for example between 0 and 90 degrees.

On the other hand, when the operator makes the nozzle 19 and the box-nut 22 screwed onto it, swivel about the axis x—x', the axis z—z', which coincides with the mean direction of the jet, passes across a cone having a vertex angle $2\alpha$ (60 degrees in the example illustrated), which is tangential to the axis y—y' of the rigid tube 3. By slightly loosening the nut 18, as has already been indicated, the operator can also make the shoulder 17 swivel about the axis y—y', so that the cone defined above, by rolling over the axis y—y', in a way, creates a larger cone, having an axis y—y' and a vertex angle equal to $4\alpha$ (120 degrees in the example illustrated). It is therefore clear that the nozzle 19 of the atomizing head according to the present invention, or, more exactly, the mean direction z—z' of the jet emerging from the outlet tube 22*a*, can take up positions different from that shown by a solid line in FIG. 5, for example the positions shown by dotted lines in the same figure and, more generally, all the possible positions corresponding to the internal solid angle of a cone having an axis y—y' and a vertex angle $4\alpha$, equal, at most, to 240 degrees.

Figures 6, 7, 8, 9, 10, 11, 12, 13:
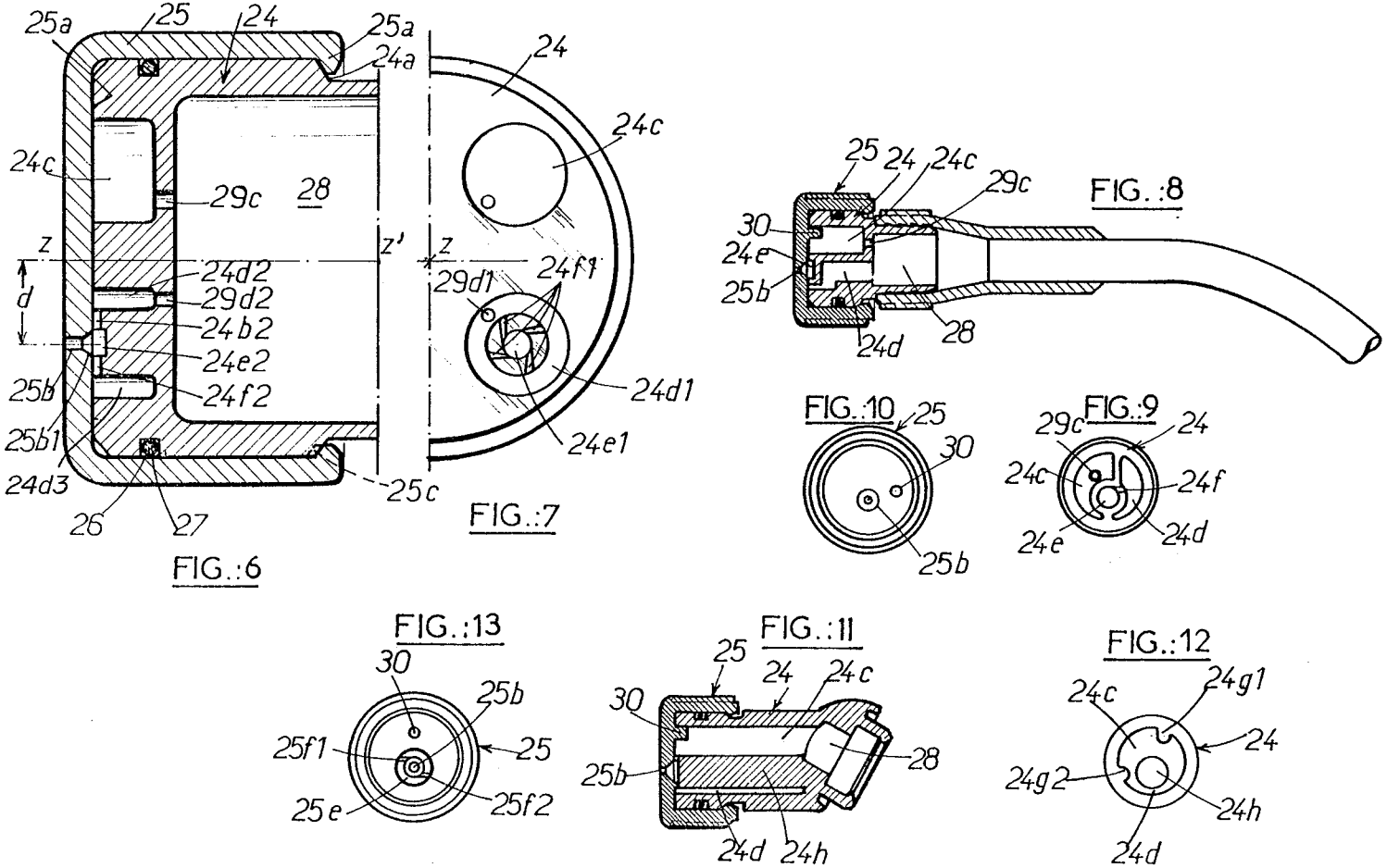
FIGS. 7, 9 and 12 are front views of the mouthpieces of the atomizing heads, illustrated respectively in FIGS. 6, 8 and 11, after removal of the rotary hood.
FIGS. 10 and 13 are views in elevation, showing the bases of the rotary hoods with which the atomizing heads of FIGS. 8 and 11 are provided.

FIG. 6 partially shows, in section through an axial plane, another embodiment of the atomizing head of a hand-operated hose according to the present invention. 24 denotes a mouthpiece of generally cylindrical shape and 25 a hood, which can be made of moulded material, particularly of moulded synthetic material; FIG. 7 is a view in elevation of the face of the mouthpiece 24, which, in FIG. 6, is shown applied against the inner front surface 25*a* of the hood 25. This latter is rotatably mounted on the front portion, having a larger cross-section, of the cylindrical mouthpiece 24; the two parts 24 and 25 are immobilised, in relation to each other, in the direction of their common axis z—z', through the interaction of re-entering parts 25*c*, developed at the rear of the skirt of the hood 25 and capable of forming, for example, a continuous annular flange with a bearing 24*a* connecting the two parts of differing cross-sections of the cylindrical mouthpiece 24. In the embodiment under consideration, the front wall of the rotary hood 25 is crossed by a single nozzle 25*b*, which comprises at least one part, having the shape of a divergent truncated cone, $25b_1$, where it issues on the rear face 25*a*. The axis of the nozzle 25*b* is placed at a predetermined distance d from the common axis z—z'. As can be seen in part in FIG. 7, four chambers or cavities are developed in the surface of the cylindrical mouthpiece 24 that is turned towards the rotary hood 25; these four chambers are denoted respectively by 24*c*, $24d_1$, $24d_2$ and $24d_3$; they are all centred at 90 degrees from one another, on the same circle, having a radius d and the centre situated on the axis z—z'. Ratchet means are provided for ensuring temporary immobilization of the rotary hood 25 in relation to the mouthpiece 24 in four angular positions differing by 90 degrees from one another, in each of which, therefore, the part $25b_1$ of the nozzle 25*b* issues at the centre of one of the four chambers 24*c* and $24d_1$ to $24d_3$. The ratchet means provided can be very diverse; for example, it can be a projection 25*c* moulded onto the re-entering element 25*a* of the rotary hood 25 and capable of interacting with four grooves spaced at intervals of 90 degrees from one another and also moulded onto the surface 24*a* of the mouthpiece 24. Any other ratchet means, for example ball and spring ratchets, can be used for the indicated purpose. A sealing O-ring 26 is inserted in an annular groove 27 of the side wall of the mouthpiece 24, so that it is tightened in said annular groove 27 by the inner wall of the skirt of the rotary hood 25.

According to the present invention, the four chambers 24*c* and $24d_1$ and $24d_3$ are supplied from a larger chamber 28 developed behind them and supplied by a flexible feed-pipe for treatment liquid (not shown in FIG. 6). The treatment liquid under pressure passes from the chamber 28 into the different chambers 24*c*, $24d_1$ to $24d_3$ through ducts such as 29*c* and $29d_2$, the cross-sections of which are different, as will be explained later on. In the exemplary embodiment illustrated, the chamber 24*c*, which is approximately cylindrical, is open across its entire cross-section towards the front wall of the hood 25, so that, when the rotary hood 25 occupies the angular position, in which the nozzle 25*b* faces the chamber 24*c*, the treatment liquid under pressure emerges from said nozzle 25*b* in the form of a jet having a small cross-section, in the shape of a small rod. On the other hand, the other three chambers, $24d_1$ to $24d_3$, all have an annular shape and their respective upper parts supply a central cavity such as $24e_1$, $24e_2$ by means of a certain number of approximately tangential ducts; these ducts, numbering four, can be seen in FIG. 7, where they are particularly denoted by $24f_1$ . . . . When the rotary hood 25 occupies, with respect to the cylindrical mouthpiece 24, an angular position such that the nozzle 25*b* is placed, for example, at the level of the cavity $24e_2$, associated with the annular chamber $24d_2$, the liquid under pressure, which is passed in approximately tangential directions into the cavity $24e_2$, creates a vortex there, which becomes active in the part having the shape of a truncated cone $25b_1$ of the nozzle 25*b*, so that a conical jet, the conical shape of which depends on the geometrical characteristics of the vortex-creating device, $24f_2$-$24e_2$-$25b_1$-25*b*, escapes from the nozzle outside the hood 25. By giving to the cavities, such as $24e_1$, $24e_2$ . . . and to their tangential feed-ducts, such as $24f_1$, $24f_2$ different configurations, and especially different dimensions, it is possible to obtain discharge through the single nozzle 25*b* of three jets of differing conical shapes, when the rotary hood 25 respectively occupies the angular positions at which its nozzle 25*b* is placed respectively at the level of the cavities such as $24e_1$, $24e_2$. Moreover, the feed-ducts, such as 29*c*, $29d_2$ . . . of the different chambers 24*c*, $24d_2$ . . . have cross-sections which, as has already been indicated, differ from one another and are adapted respectively to the configurations and to the dimensions of the corresponding chambers, 24*c*, $24d_2$ . . . , and to those of the nozzle 25*b*, so as to obtain, in each of the four angular positions defined above of the rotary hook 25, jets having approximately the same flow-rate.

The variant illustrated in FIGS. 8 to 10 essentially differs from that of FIGS. 6 and 7 in that a single chamber 24*d* is provided for the production of a conical jet; the rotary hood 25 thus has only two predetermined angular positions in which its rotary movement is stopped, for example with a ratchet mechanism, due to the interaction of a lug 30, projecting across the internal surface of the rotary hood 25, with abutments that are integrated with the mouthpiece 24 (not shown). On the other hand, the two chambers 24*c* and 24*d* have cross-sections of differing shapes; in particular, the chamber 24*d* is supplied over its whole cross-section by the rear feed-chamber 28, and it supplies the cavity 24*e* of the vortex-creating device through a single tangential slit 24*f*. In this embodiment, again, the cross-section of the channel 29*c*, which supplies the chamber 24*c*, is chosen so that the threaded jet, produced when the nozzle 25*b* is placed opposite the chamber 24*c*, has approximately the same flow-rate as the conical jet produced when the nozzle 25*b* is placed opposite the cavity 24*e*.

In the variant illustrated in FIGS. 11 to 13, the rotary hood 25, again, has only two angular positions, predetermined by the interaction of the lug 30, which is integrated by its internal surface (FIG. 13) with abutments $24g_1$ and $24g_2$ developed inside the mouthpiece 24. The latter comprises, upstream of the feed-chamber 28, a single chamber in which an eccentric cylindrical core 24*h*, integrated with the mouthpiece 24, delimits two parts of differing radial widths 24*c* and 24*d* situated on either side of the core 24*h*; the vortex-creating device 25*e* is integrated with the internal surface of the rotary hood 25, with which, for example, it has been moulded concentrically with the nozzle 25*b* as well as two tangential feed-slits $25f_1$ and $25f_2$; the arrangement is such that the circular groove, in which the two feed-slits $25f_1$ and $25f_2$ are made, is applied, almost sealingly, against the corresponding surface of the core 24*h* of the mouthpiece 24 when the hood 25 is placed on the mouthpiece 24 and occupies the appropriate angular position; in this case, the chamber 24*d* feeds the vortex generator 25*e* through the two slits $25f_1$, $25f_2$ and the outlet tube 25*b* produces a conical jet; by way of contrast, when the rotary hood 25 has been turned so as to bring the nozzle 25*b* opposite the chamber 24*c*, the nozzle 25*b* produces a thread-shaped jet, since the vortex-creating device 25*e* is no longer supplied exclusively through its tangential slits $25f_1$ and $25f_2$; it is understood that the assembly can be dimensioned so that the two jets produced have approximately the same flow-rate.

The present invention is not limited to the embodiments described above. It includes all their variants, some of which have already been indicated. Amongst the improvements according to the present invention, which have been described above, some apply to the handle of the hand-operated hose and to the control elements with which it is provided, others to its atomizing head. It is obvious that the improvements, according to the present invention, of a handle of a hand-operated hose and of its control elements are applicable to any hand-operated hose, equipped with any atomizing head, and that any hand-operated hose, the handle and control elements of which are not endowed with the improvements according to the present invention, can be equipped with an atomizing head according to the present invention; in both cases, the improved hand-operated hose would fall within the scope of the present invention.

The fraction l, of the length L of the filter, which, according to FIG. 1, engages with the front portion of the tubular handle 1, can be chosen at will; the ratio l/L, in particular, can have any value between a minimum value, which is just sufficient to allow engagement of the projecting base 5*a* of the filter 5 in the tubular handle to take place, and a maximum value, which, in practice, is equal to 1. The internal element 2*c* of the box-nut 2 (FIG. 1), instead of having the shape of a skirt, could be composed of one or more internal projections having approximately axial direction and appropriate length. Instead of being provided, beyond its articulated joint 13 to the body 6*a* of the valve with an extension 12*a*, interacting with a fixed incline 14, the control trigger 12 (FIGS. 2 to 4) could be mounted in a different way, in a more conventional manner; its extension 12*a* could be articulated in a fixed point of the base 5*a* of the filter 5 or of the rigid tube 10, the trigger being also provided with an axial groove interacting with a shaft 13, integrated with the portion 6*a* of the valve body; other known mechanical devices could be used. The rigid tube 3, instead of constituting an independent part of the tubular handle 1, could be formed by a tubular extension of the latter, at the free end of which the atomizing head would be mounted. As has already been indicated, the value of the angle $\alpha$ between the axes y—y′ and x—x′ (FIG. 5) could be chosen greater than 45 degrees and, at most, equal to 60 degrees, in particular; such embodiments would make it possible to discharge the jet in a direction z—z′, making with the axis y—y′ an angle greater than 90 degrees and possibly reaching 120 degrees, which would enable the operator, for example, to atomize the liquid onto the rear surface of the leaves of the plants under treatment. In the case of the embodiment of the atomizing head, which is illustrated in FIG. 5, the box-nut 22 could be replaced by a rotary hood similar to that described in connection with FIGS. 6 to 13.

What I claim is:

1. A hand operated hose for atomizing a liquid, especially a liquid useful in the treatment of plants, said hose comprising a rigid tubular handle having a wall, a rear end and a front end with an outer thread, a transverse base plate separately inserted in said tubular handle near to its front end, said transverse base plate having first and second holes therein, an elongated closing member tightly and slidingly mounted through said first hole in said transverse base plate, a control trigger engaged through a longitudinal slot in the handle wall, said control trigger having an inner end connected to one end of said elongated closing member for sliding said member through said first hole, a tubular-shaped filter having a cross-sectional size substantially less than the cross-sectional inner size of the front end of said tubular handle and at least partially engaged in the front end of said tubular handle in a substantially coaxial relationship to said handle, a box-nut threadedly engaged on the outer thread of the front end of said handle, said box-nut being adapted to fix said tubular-shaped filter so that the inner end of said filter tightly engages said transverse base plate and an annular chamber is defined between respective walls of said tubular-shaped filter and of said box-nut, said second hole being located in said transverse base plate so as to open in said annular chamber, said box-nut having a first inner tubular part engaged in said tubular-shaped filter and forming a tight seat for the other end of said closing member, an atomizing head, conduit means to connect the tubular part of said box-nut to said atomizing head, and conduit means to feed the liquid to the atomized through the rear end of said hollow handle up to said second hole in the transverse base plate.

2. A hand-operated hose according to claim 1, wherein the transverse base plate, the closing member mounted through its first hole and the conduit means connected to its second hole form a unitary assembly which can be separated from the hollow handle, when the box-nut is unscrewed.

3. A hand-operated hose according to claim 2, wherein the rim of the separable transverse base plate is tightened against an inner annular shoulder arranged in the inside face of the base plate of the tubular handle by at least a second inner tubular part of the box-nut.

4. A hand-operated hose according to claim 3, wherein a single tight joint is inserted between the rim of the separable transverse wall and the inner face of the wall of the tubular handle.

5. A hand-operated hose according to claim 1, wherein the longitudinal slot of the handle wall for the control trigger has a sufficient length for said trigger engaging along its whole length inside said tubular handle.

6. A hand-operated hose according to claim 5, wherein the inner face of the tubular handle wall is provided with at least one incline-shaped projection, arranged so as to interact with at least one lug-shaped projection of the control trigger, so that, when the filter is pushed towards either the front end or towards the rear end of the tubular handle, said control trigger is moved so as either to engage along its whole length inside said tubular handle or to come partially out of it through said longitudinal slot.

7. A hand operated hose for atomizing a liquid, especially a liquid useful in the treatment of plants, said hose comprising an atomizing head, conduit means to feed the liquid to said atomizing head, a rigid handle, an inlet valve having a closing member movable in a first predetermined direction and a closing spring adapted to move said closing member into its closing position, said inlet valve being inserted in said conduit means, a control trigger connected to said movable closing member, said inlet valve and control trigger being mounted in said handle, a fixed incline-shaped projection arranged in said handle to be inclined in a second predetermined direction not perpendicular to said first direction, said control trigger further having an extension adapted to interact with said incline-shaped projection, whereby, when a traction is manually applied to said trigger, its extension is guided by said incline-shaped projection so that said trigger exerts on the closing member of said inlet valve a multiplied traction, sufficient for overcoming the force of said closing spring.

8. A hand-operated hose according to claim 7, wherein the incline-shaped projection has a ratchet element for temporarily locking the control trigger in a position corresponding to the opening of said inlet valve.

9. A hand-operated hose device for atomizing a liquid, especially a liquid useful in the treatment of plants, said hose device comprising an elongated rigid handle having a front end and a rear end, a rigid tube extending away from the front end of said rigid handle, said rigid tube including a first end nearest said rigid handle and a second end remote therefrom, said second end defining a longitudinal axis Y—Y'; a valve means within said rigid handle, said valve means including a seat adapted to be permanently connected to the first end of said rigid tube, a closing member which is movable toward and away from said seat to close and open said seat, and a spring to bias said closing member toward said seat; a control trigger attached to said closing member, said control trigger being capable of moving said closing member away from said seat; and an atomizing head, said atomizing head including a nozzle-mounting means, said nozzle-mounting means being adjustably attached at its first end to the second end of said rigid tube so as to be swivelable about said axis Y—Y', said nozzle-mounting means including a hollow shaft at its second end which provides an elongated flow channel that extends along an axis X—X', said axis X—X' extending at a fixed angle $\alpha$ with respect to said axis Y—Y'. said angle $\alpha$ being less than 60°, and a nozzle means which includes a flow duct that communicates with said flow channel of said nozzle-mounting means, said nozzle means including a first end and a second end, said first end of said nozzle means being adjustably connected to the second end of said nozzle-mounting means such that said nozzle means is swivelable about said axis X—X'.

10. A hand-operated hose device according to claim 9, wherein said flow duct in said nozzle means is elongated and extends along an axis Z—Z', said axis Z—Z' extending at a fixed angle with respect to said axis X—X', said fixed angle being equal to said angle $\alpha$.

11. A hand-operated hose device according to claim 10, wherein the second end of said nozzle-mounting means includes a planar bearing surface, wherein the first end of said nozzle means includes a planar bearing surface, and wherein said planar bearing surfaces are in slidable contact with one another.

12. A hand-operated hose device according to claim 11, wherein said planar bearing surfaces include cooperating annular indentations therein, and wherein a sealing O-ring is positioned within the cooperating annular indentations.

13. A hand-operated hose device according to claim 12, wherein one of the planar bearing surfaces includes an annular groove and the other of the planar bearing surfaces includes a cylindrical skirt, and wherein said cylindrical skirt fits within said annular groove.

14. A hand-operated hose device according to claim 13, wherein said planar bearing surface extend perpendicularly to said axis X—X'.

15. A hand-operated hose device according to claim 10, wherein said flow duct in said nozzle means extends to the second end of said nozzle means, and wherein a box-nut is adjustably connected to the second end of said nozzle means, said box-nut including an outlet hole therein.

* * * * *